US008161886B2

(12) United States Patent
Meyer

(10) Patent No.: US 8,161,886 B2
(45) Date of Patent: Apr. 24, 2012

(54) SHORT MAGNUM SHOTSHELL CARTRIDGE AND FIRING ASSEMBLY

(75) Inventor: Stephen W. Meyer, Alhambra, IL (US)

(73) Assignee: Olin Corporation, East Alton, IL (US)

( * ) Notice: Subject to any disclaimer, the term of this patent is extended or adjusted under 35 U.S.C. 154(b) by 294 days.

(21) Appl. No.: 12/268,804

(22) Filed: Nov. 11, 2008

(65) Prior Publication Data

US 2010/0281744 A1 Nov. 11, 2010

Related U.S. Application Data

(62) Division of application No. 11/043,225, filed on Jan. 25, 2005, now Pat. No. 7,451,706.

(51) Int. Cl.
*F42B 14/00* (2006.01)
*F41C 27/00* (2006.01)

(52) U.S. Cl. ..... 102/520; 102/523; 102/446; 42/76.01; 42/77

(58) Field of Classification Search ..... 102/523, 102/522, 521, 520, 446, 439, 444; 42/76.01, 42/77, 78

See application file for complete search history.

(56) References Cited

U.S. PATENT DOCUMENTS

| | | | | |
|---|---|---|---|---|
| 1,760,731 | A * | 5/1930 | Williams | 42/76.01 |
| 3,262,391 | A | 7/1966 | Shober | 102/93 |
| 3,527,137 | A | 9/1970 | Scanlon | 89/1.1 |
| 3,640,013 | A | 2/1972 | Franklin | 42/77 |
| 3,726,231 | A | 4/1973 | Kelly et al. | 102/93 |
| 3,952,657 | A | 4/1976 | Kaltmann | 102/38 |
| 4,126,955 | A | 11/1978 | Coffield et al. | 42/78 |
| 4,434,718 | A | 3/1984 | Kopsch et al. | 102/522 |
| 4,454,674 | A | 6/1984 | Bockstruck | 42/76 R |
| 4,614,157 | A | 9/1986 | Grelle et al. | 102/466 |
| 4,644,865 | A | 2/1987 | Laurence | 102/430 |
| 5,214,238 | A | 5/1993 | Young | 102/520 |
| 5,415,102 | A | 5/1995 | White et al. | 102/522 |
| 6,038,978 | A | 3/2000 | Harris et al. | 102/467 |
| 6,164,209 | A | 12/2000 | Best et al. | 102/450 |
| 6,564,720 | B1 | 5/2003 | Meyer et al. | 102/522 |
| 2003/0089221 | A1 * | 5/2003 | O'Dwyer | 89/14.6 |
| 2006/0011092 | A1 | 1/2006 | Mochak | |

FOREIGN PATENT DOCUMENTS

| | | |
|---|---|---|
| DE | 3918641 A1 | 12/1990 |
| GB | 2422420 A | 7/2006 |
| GB | 2431710 A | 5/2007 |

OTHER PUBLICATIONS

United Kingdom Search and Examination Report Date: Feb. 26, 2007, pp. 5.

* cited by examiner

*Primary Examiner* — James Bergin
(74) *Attorney, Agent, or Firm* — Harness, Dickey & Pierce, P.L.C.

(57) ABSTRACT

A sabot-retaining shotshell cartridge and firing assembly including a barrel or barrel insert for firing the sabot-retaining shotshell cartridge. The shotshell cartridge includes a cylindrical hull, a sub-caliber projectile, a propellant charge, and a sabot. A central pathway or thin membrane is defined within the base of the sabot between the sub-caliber projectile and propellant charge. The barrel or barrel insert for firing the cartridge includes a transitional area between chamber and sub-caliber rifled bore to retain sabot in the cartridge. Upon cartridge firing, propellant gases flow through central portion of sabot base propelling projectile out of the sabot and into sub-caliber rifled bore.

12 Claims, 4 Drawing Sheets

SHORT MAGNUM SHOTSHELL CARTRIDGE AND FIRING ASSEMBLY

CROSS-REFERENCE TO RELATED APPLICATIONS

This application is a divisional of U.S. patent application Ser. No. 11/043,225, filed Jan. 25, 2005, which is now U.S. Pat. No. 7,451,706, issued Nov. 18, 2008.

BACKGROUND OF THE INVENTION (1) Field of the Invention

This invention relates to a shotgun cartridge and assembly for firing, and more particularly to a sabot-retaining shotshell cartridge, shotgun chamber, and barrel or barrel insert configured to fire the shotshell cartridge.

(2) Description of the Related Art

The use of slugs with shotguns is intertwined with the history of shotguns themselves. U.S. Pat. No. 3,726,231 discloses a waisted slug known as the BRI slug or bullet. Such waisted slugs grew to prominence in the 1970's and 1980's. That period saw increased interest in use of shotgun slugs motivated by a combination of user preference and regulatory influence. The availability of rifled shotgun barrels also increased, further enhancing slug performance and increasing the use of saboted projectiles. In parallel, the field of muzzle-loading rifles has flourished with a dedicated following. Saboted projectiles may also be used with muzzle-loading rifles.

There are ongoing development efforts in saboted projectile technology. U.S. Pat. No. 5,214,238 discloses a sabot for chambering conventional bullets in a shotgun. U.S. Pat. No. 5,415,102 discloses a muzzle loading sabot. General dimensions of shotshell cartridges and pistol bullets are respectively disclosed in *American National Standard Voluntary Industry Performance Standards for Pressure and Velocity of Shotshell Ammunition for the Use of Commercial Manufacturers* and in *Voluntary Industry Performance Standards for Pressure and Velocity of Centerfire Pistol and Revolver Ammunition for the Use of Commercial Manufacturers* ANSI/SAAMI Z299.2-1992 and Z299.3-1993 (American National Standards Institute, New York, N.Y.).

Sub-caliber projectiles in shotshells or shotshell cartridges are desirable to increase velocity levels, improve ballistic coefficients, and flatten the trajectory of the bullet path. Many varieties of sabots, e.g., one-piece, multi-petal, or two-piece, are currently used in shotshell cartridges for sub-caliber projectile applications. Existing sabot designs typically suffer from at least one of two problems: 1) excessive ejecta weight and 2) accuracy issues. Prior art designs, which include bulky sabots, over powder cups, and various spacer wads, typically significantly increase ejecta weight. Higher ejecta weight reduces the velocity level that may be achieved. Higher ejecta weight also contributes to greater recoil energy felt by the shooter for a given velocity level. In spin-stabilized systems, the sabot must locate the sub-caliber projectile precisely in the center of the bore and the projectile/sabot separation at muzzle exit must not induce any unbalanced forces on the projectile. Using known designs, these criteria may be very difficult to achieve consistently, resulting in degraded accuracy as compared to the same projectile fired in a non-sabot system. These problems become more pronounced as the difference between the sub-caliber projectile diameter and bore diameter increases, which restricts the use of more efficient, smaller-caliber projectiles.

BRIEF SUMMARY OF THE INVENTION

One aspect of the present invention is a shotshell cartridge for use in a sabot-retaining shotshell cartridge chamber including a sub-caliber projectile having a frontal portion at one end, a base at an opposite end, and sidewalls between the frontal portion and the base, a propellant charge, a sabot accommodating the projectile, the sabot including at least one of a central pathway and thin membrane between the base of the projectile and the propellant charge, a hull including a front portion and an aft portion, the hull configured to extend along a substantial portion of a length of the shotshell cartridge, the hull accommodating the sabot, the projectile, and the propellant, and a cap attached to the hull adjacent the aft portion of the hull, the cap having a centrally seated primer.

Another aspect of the present invention is a shotgun barrel for adapting a standard shotgun to fire sabot-retaining shotshell cartridges including sub-caliber projectile. The shotgun barrel includes a chamber having a diameter and length adapted to accept the cartridge, a rifled bore having a diameter substantially the same as a diameter of the sub-caliber projectile, and a transitional area between the chamber and the bore for retaining a sabot of the cartridge in a hull of the cartridge upon firing.

Another aspect of the present invention is a rifled barrel insert for adapting a standard shotgun having a standard barrel and a standard chamber to fire sabot-retaining shotshell cartridges including sub-caliber projectiles. The rifled barrel insert includes a rifled barrel insert having a sub-caliber bore adapted to fit the sub-caliber projectile, the rifled barrel insert adapted to removably fit within and extend along the length of the standard barrel of the standard shotgun from a muzzle end of the standard barrel to the cartridge, the rifled barrel insert including a slight taper for guiding the sub-caliber projectile upon separation from the sabot, and a mechanism within the rifled barrel for retaining the sabot in the cartridge upon firing.

Still another aspect of the present invention is a system for firing a sabot-retaining shotshell cartridge including a sub-caliber projectile. The systems includes the following components: a sub-caliber projectile including a frontal portion at one end, a base at an opposite end, and sidewalls between the frontal portion and the base; a propellant charge; a sabot accommodating the projectile, the sabot including a central pathway or thin membrane between the base of the sub-caliber projectile and the propellant charge, the sabot including a rigid washer or ledge supporting the sub-caliber projectile in front of the thin membrane or central pathway; a hull including a front portion and an aft portion, the hull configured to extend along a substantial portion of a length of the shotshell cartridge, the hull accommodating the sabot, the projectile, and the propellant; a cap attached to the hull adjacent the aft portion of the hull, the cap having a centrally seated primer; a chamber including a diameter and length sized to accept the cartridge; a rifled bore having a diameter substantially the same as a diameter of the sub-caliber projectile; and a transitional area between the chamber and the bore for retaining the sabot of the cartridge in a hull of the cartridge upon firing.

Yet another aspect of the present invention is a system for firing a sabot-retaining shotshell cartridge including a sub-caliber projectile in a standard shotgun having a standard barrel and standard chamber. The system includes the following components: a sub-caliber projectile including a frontal portion at one end, a base at an opposite end, and sidewalls between the frontal portion and the base; a propellant charge; a sabot accommodating the projectile, the sabot including a central pathway or thin membrane between the base of the sub-caliber projectile and the propellant charge, the sabot including a rigid washer or ledge supporting the sub-caliber projectile in front of the thin membrane or central pathway; a hull including a front portion and an aft portion, the hull configured to extend along a substantial portion of a length of the shotshell cartridge, the hull accommodating the sabot, the projectile, and the propellant; a cap attached to the hull adjacent the aft portion of the hull, the cap having a centrally seated primer; a rifled barrel insert having a sub-caliber bore adapted to fit the sub-caliber projectile, the rifled barrel insert adapted to removably fit within and extend along the length of the standard barrel of the standard shotgun from a muzzle end of the standard barrel to the cartridge, the rifled barrel insert including a slight taper for guiding the sub-caliber projectile upon separation from the sabot; and means within the rifled barrel for retaining the sabot in the cartridge upon firing.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

For the purpose of illustrating the invention, the drawings show one or more embodiments of the invention. However, it should be understood that the present invention is not limited to the precise arrangements and instrumentalities shown in the drawings, wherein.

DETAILED DESCRIPTION OF THE INVENTION

Figure 1:
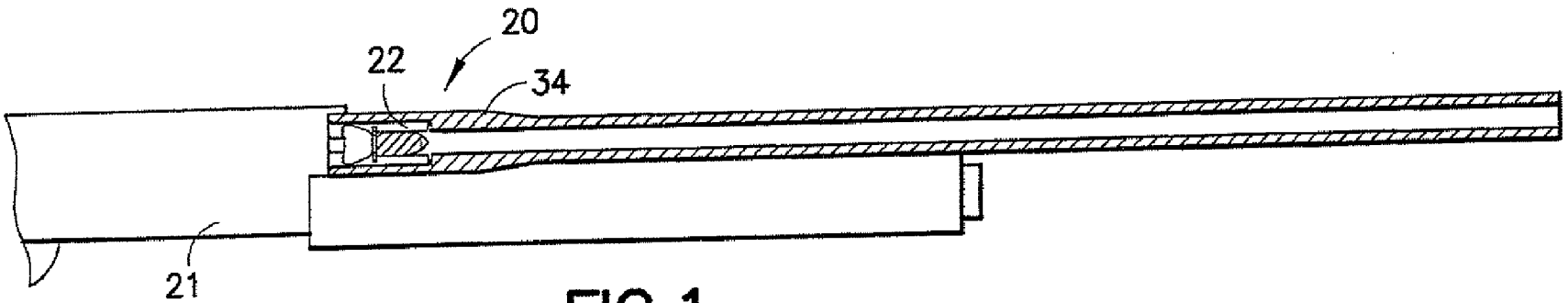
FIG. 1 is a partial cross-section of a shotgun including a shotgun chamber and barrel having a shotshell cartridge, all according to one embodiment of the present invention.
Figure 2:
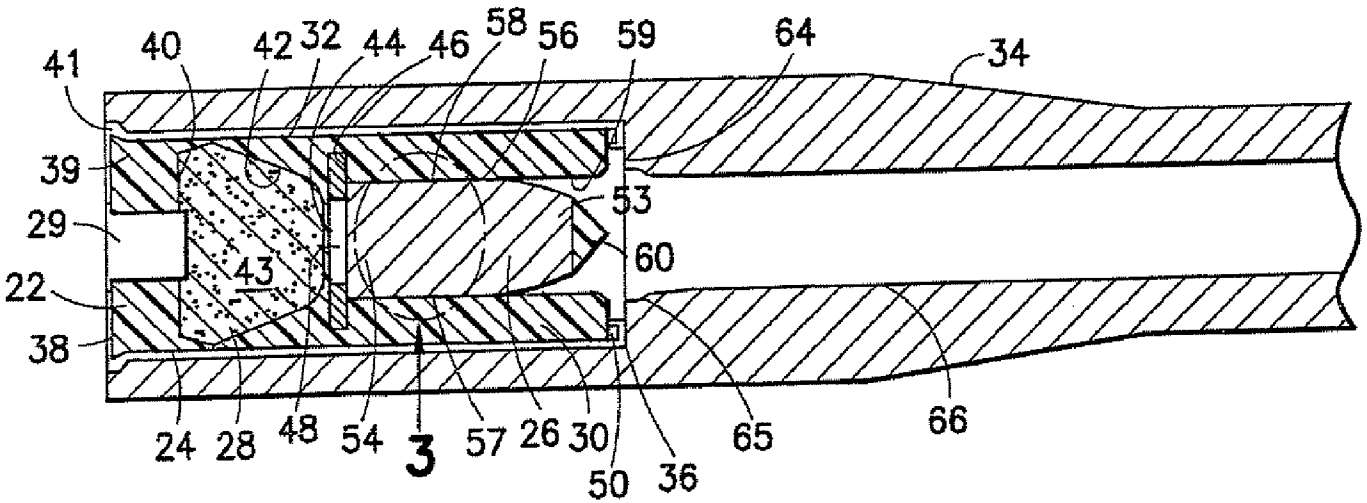
FIG. 2 is an enlarged partial cross-section of a shotshell cartridge and barrel according to one embodiment of the present invention.

Referring now to the drawings in which like reference numerals indicate like parts, and in particular to FIGS. 1 and 2, the present invention is a shotgun assembly 20 included in a shotgun 21, which is adapted to fire a sabot-retaining shotshell cartridge 22. Shotshell cartridge 22, which generally includes a cylindrical hull 24, a sub-caliber projectile 26, a propellant charge 28, a primer 29, and a sabot 30, is contained within a chamber 32 of a specialized shotgun barrel 34. Generally, sabot-retaining shotshell cartridge 22 is formed using known materials as described in U.S. Pat. Nos. 6,038,978, 6,164,209, and 6,564,720, which are hereby incorporated by reference as if fully disclosed in their entirety.

As shown in FIG. 2, cylindrical hull 24 typically includes a front portion 36 and an aft portion 38. Aft portion 38, which includes a basewad portion 39 having a concave front section 40, is closed by a cap 41. Cylindrical hull 24 is typically formed from plastic but may also be made from cardboard or other materials typically found in the art. Cap 41 is typically formed from a metallic material but may also be formed from hard plastic or other materials known in the art. Shotshell cartridge 22 and cylindrical hull 24 may be any gauge, but in one embodiment is 12 gauge. As described further below, the length of cylindrical hull 24 and shotshell cartridge 22 overall may be shorter than a standard shotshell cartridge of comparable gauge. In one embodiment, the length of shotshell cartridge 22 is 1.85 inches, which is less than a standard shotshell cartridge of comparable gauge.

Sabot 30, which is generally a cylindrical body, includes a concave base section 42, is typically positioned within cylindrical hull 24, and extends from front portion 36 toward aft portion 38. Propellant charge 28 is contained in a propellant compartment 43, which is defined between concave base section 42 and concave front section 40. Sabot 30 houses sub-caliber projectile 26. A membrane or central pathway 44 is typically defined within sabot 30, and is generally positioned between sub-caliber projectile 26 and propellant charge 28. The thickness of membrane 44 is typically selected so that it may be caused to rupture upon firing of propellant charge 28 when the cartridge is fired in barrel 34. In one embodiment, membrane 44 has a thickness of 0.030. Depending on the size bore of barrel 34 and diameter of projectile 26, the membrane thickness may vary. Also defined within sabot 30 is a support washer or ledge 46, which is generally positioned between projectile 26 and membrane 44. After rupturing membrane 44, propellant gases flow through a central hole 48 of washer 46 when fired in specialized barrel 34 to propel projectile 26 out the barrel. If cartridge 22 is mistakenly fired in a standard barrel with full bore, washer 46 provides support to counteract setback forces encountered during ignition, thereby keeping projectile 26 and sabot 30 together as a unit as both are propelled out the barrel. In one embodiment, washer 46 is formed of steel and is insert molded in sabot 30. In such an embodiment, washer 46 may have an outside diameter of 0.625 inch, an inside hole diameter of 0.375 inch, and a thickness of 0.063 inch, A roll crimp 50 at front portion 36 of cylindrical hull 24 secures sabot 30 to cartridge 22 to prevent its separation from the cartridge during typical handling. Of course, sabot 30 may be secured to cartridge 22 by any other acceptable methods used in the art. Sabot 30 is typically formed from a plastic but may also be made using other materials known in the art.

Figure 3:
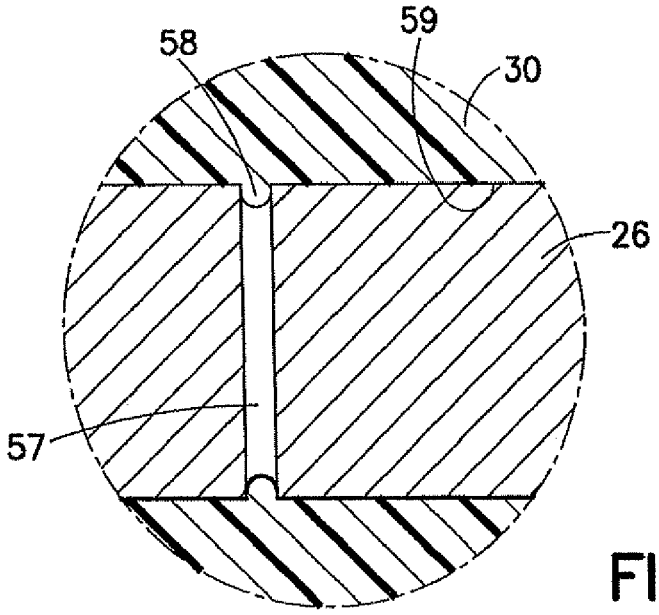
FIG. 3 is an enlarged partial cross-section of a sub-caliber projectile and sabot according to one embodiment of the present invention.

Sub-caliber projectile 26 is typically positioned within front portion 36 of shotshell cartridge 22 and within sabot 30. Sub-caliber projectile 26 generally includes a frontal portion 53, a base 54 at an opposite end, and sidewalls 56 between the frontal portion and the base. Sub-caliber projectile 26 is typically positioned within sabot 30 with base 54 in contact with or adjacent to washer 46. Sub-caliber projectile 26 is secured in sabot 30 when an annular groove 57 of the projectile is positioned over raised annular ring 58 on an interior sabot surface 59 as shown in FIG. 3. Sub-caliber projectile 26 is typically formed from metallic material components, but may also be made using other material known in the art. Sub-caliber projectile 26 may or may not include a plastic tip insert 60 to enhance the ballistic coefficient. Sub-caliber projectile 26 may be any caliber, but in one embodiment is .41 caliber.

Figure 4:
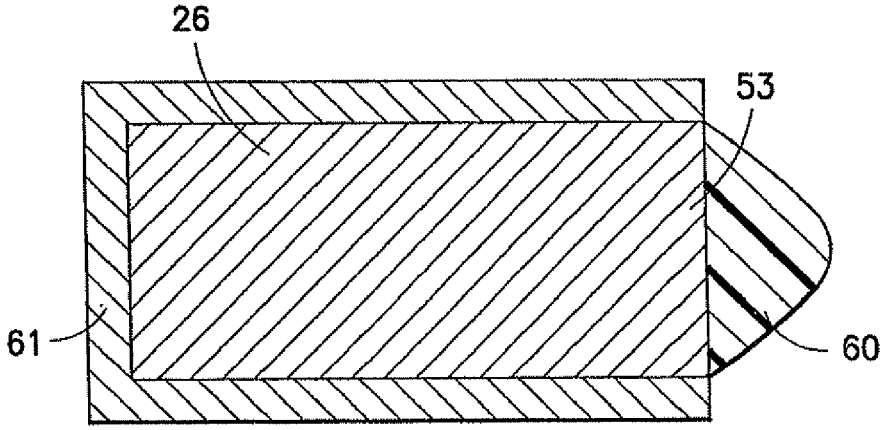
FIG. 4 is a cross-section of a sub-caliber projectile according to one embodiment of the present invention.
Figure 5:
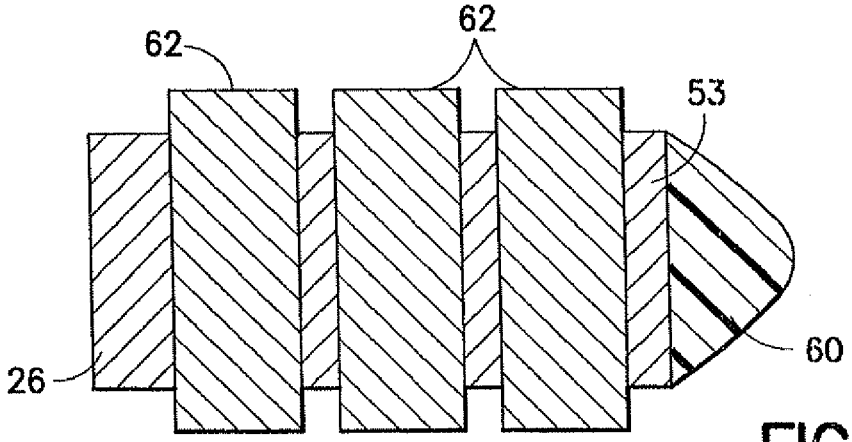
FIG. 5 is a cross-section of a sub-caliber projectile according to another embodiment of the present invention.
Figure 6:
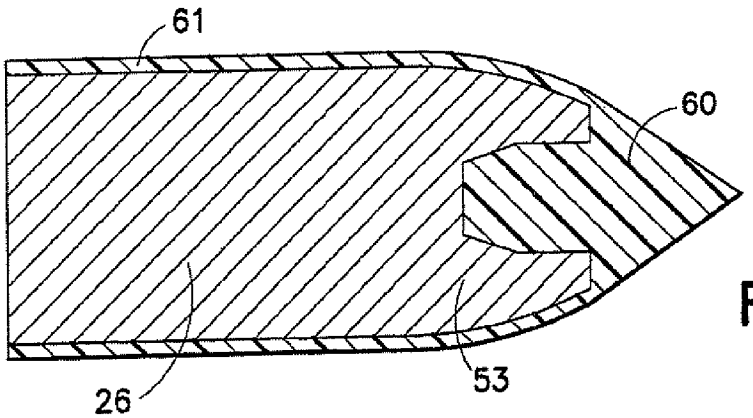
FIG. 6 is a cross-section of a sub-caliber projectile according to another embodiment of the present invention.
Figure 7:
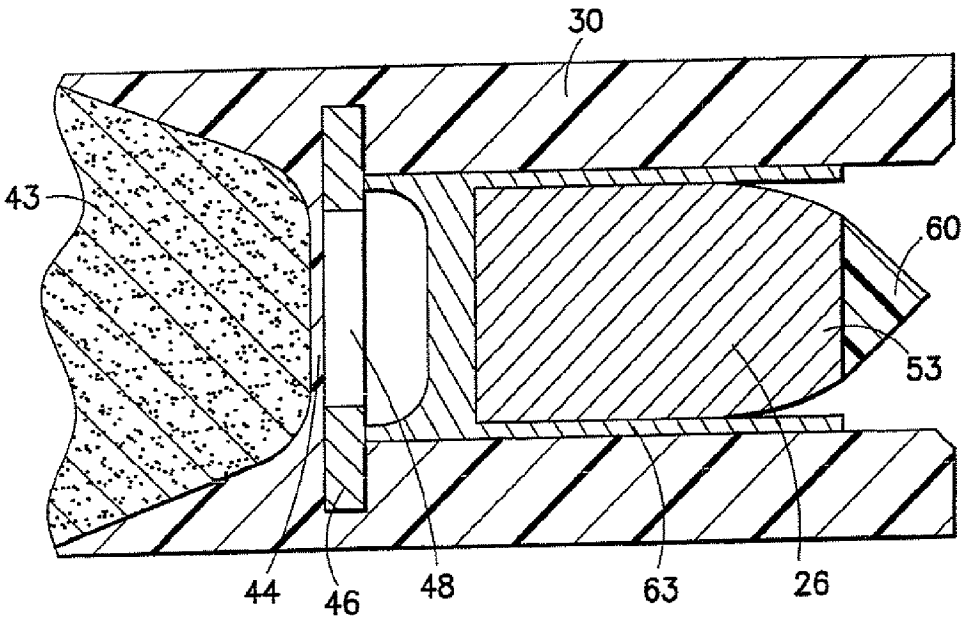
FIG. 7 is a cross-section of a sub-caliber projectile according to another embodiment of the present invention.

Referring now to FIGS. 4-7, to improve the pressure vs. velocity relationship, in some embodiments of the present invention, sub-caliber projectile 26 may include a thin coating/layer 61 (as shown in FIG. 4), e.g., plastic or similar, or reduced contact area with narrow driving bands 62 (as shown in FIG. 5) to reduce engagement forces imparted by the rifling in the barrel. Referring now to FIG. 6, in one embodiment, layer 61 and tip insert 60 may be formed from the same material and be of a monolithic construction. Referring now to FIG. 7, in another embodiment, a .36 caliber projectile 26 may be housed in a thin-petal .41 caliber secondary sabot 63, both of which may be positioned in sabot 30. In such an embodiment, secondary .41 caliber sabot 63 and .36 caliber projectile 26 separate from sabot 30 as a unit and exit chamber 32 as a unit. Separation from secondary sabot 63 occurs at the muzzle exit (not shown) of barrel 34. The projectile and sabot sizes recited herein are exemplary and not meant to be limiting. Projectiles and sabots having sizes other than those recited herein are contemplated by the present invention.

Referring again to FIG. 2, specialized barrel 34 is adapted to properly fire cartridge 22 and includes chamber 32, a transitional area 64, a throat taper 65, and a rifled sub-caliber bore 66. Specific dimensions relating to the rim and chamber diameter of a given gauge are disclosed in *American National Standard Voluntary Industry Performance Standards for Pressure and Velocity of Shotshell Ammunition for the Use of Commercial Manufacturers s* ANSI/SAAMI Z299.2-1992 (American National Standards Institute, New York, N.Y.). In one embodiment of the present invention, chamber 32 is 12 gauge. However, length of chamber 32 is considerably shorter than standard chambers to prevent the chambering and firing of standard shotshells into the restricted sub-caliber bore 66. Chamber diameter is substantially reduced to that of the projectile diameter in transitional area 64. In one embodiment, the sub-caliber bore is .41 caliber. Transitional area 64 serves to contain sabot 30 in cartridge 22 and separate projectile 26 from the sabot during the firing sequence. FIG. 2 shows an embodiment where transitional area 64 is defined by a shoulder 64, followed by taper throat 65 leading into rifled sub-caliber bore 66. Taper throat 65 is typical of rifled barrels and serves to gradually introduce projectile 26 to the rifling and final bore diameter. In such an embodiment, specialized barrel 34 fits standard shotgun receivers with interchangeability that is similar to that of standard smooth bore barrels and rifled barrels on such shotgun receivers.

Figure 8:
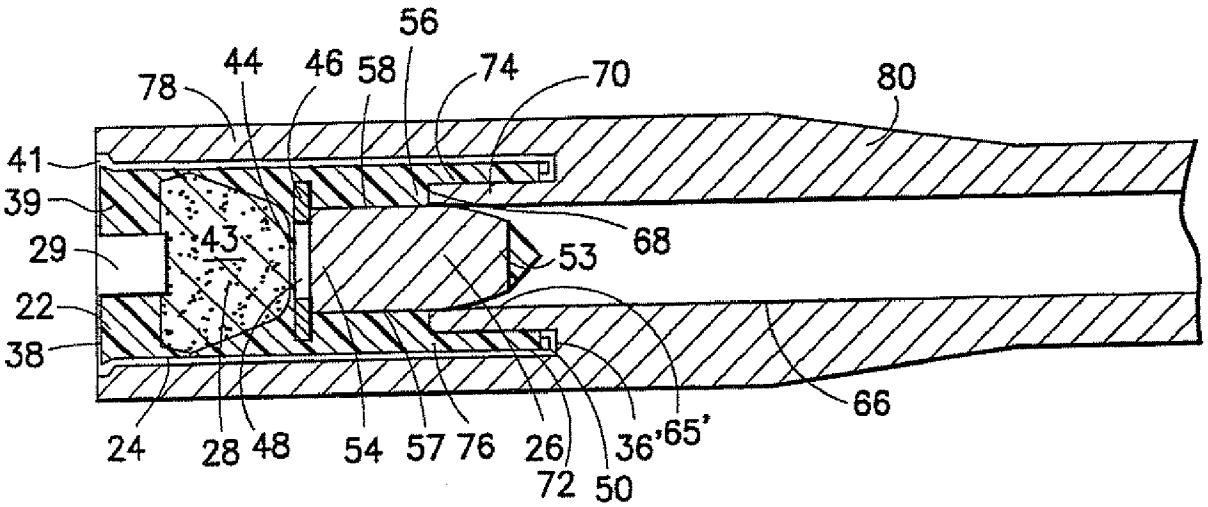
FIG. 8 is an enlarged partial cross-section of a shotshell cartridge and barrel according to another embodiment of the present invention.

Now referring to FIG. 8, in another embodiment, a diametric transitional area 68 includes an annular protruding tang 70 extending axially into the chamber, which fits within an annular groove 72 between frontal portion 53 of projectile 26 and an annular step 74 in a sabot 76, thereby encircling a portion of the sub-caliber projectile. In this way, when the shotgun is fired, annular tang 70 contacts annular step 74 of sabot 76 to retain the sabot within shellcase hull 24 and a chamber 78. In addition, an interior surface (not shown) of annular tang 70 also acts as a throat taper 65' section of a rifled barrel 80. The embodiment illustrated in FIG. 8 may be manufactured using centrally-recessed end mills or reamers or EDM methods. In an embodiment configured to fire a 12 gauge cartridge and .41 caliber projectile, annular tang 70 may protrude 0.325 inch into chamber 78 and have a radial thickness of 0.100 inch, thus creating annular groove 72, which is 0.325 inch deep and 0.095 inch wide. Annular step 74 of sabot 76 and front portion of hull 36' are sized to fit within annular groove 72. Of course, in embodiments configured to fire different sized cartridges and different sized projectiles, the length and radial thickness of annular tang 70, the depth and width of annular groove 72, and the size of annular step 74, will all vary accordingly.

Figure 9:
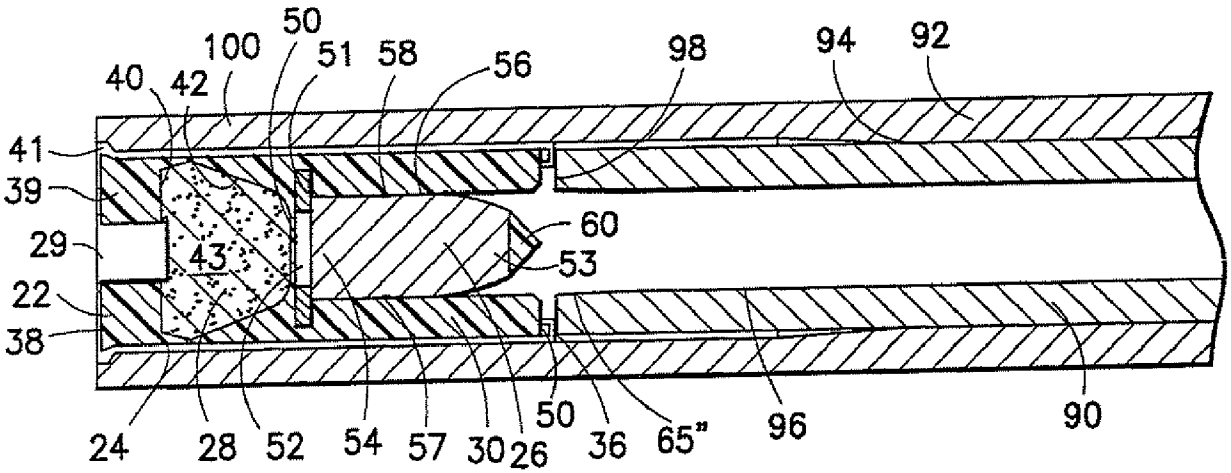
FIG. 9 is a cross-section of a shotgun chamber, shotshell cartridge, standard shotgun barrel and barrel insert tube according to another embodiment of the present invention.

Now referring to FIG. 9, in still another embodiment, a rifled barrel insert 90 provides the diametric transition. Rifled barrel insert 90 removably fits within standard barrel 92 of a standard shotgun (not shown) and properly engages shotshell cartridge 22. Of course, in other embodiments, rifled barrel insert 90 may permanently fit within barrel 92. Rifled barrel insert 90 is concentrically positioned within barrel 92 and typically extends from front portion 36 of cartridge 22 to the muzzle end (not shown) thereby fully lining the barrel. Rifled barrel insert 90 may be secured in barrel 92 using a threaded connection, which is typically positioned near the muzzle end (not shown) of barrel 92. Internal threads are typical of smooth bore barrels with screw-in choke tubes. Of course, rifled barrel insert 90 may be permanently or non-permanently secured in barrel 92 using any other method, device, or connection. Barrel 90 typically has a large bore 94 while rifled barrel insert 90 is a sub-caliber barrel having a small bore 96, which is smaller than the large bore of the barrel.

In one embodiment, large bore 94 is 12 gauge while small bore 96 is .41 caliber. In such an embodiment, shotshell cartridge 22 includes a 12 gauge shellcase hull 24 and a .41 caliber sub-caliber projectile 26. The thickness and outside diameter of rifled barrel insert are determined by the size of large bore 94 and sub-caliber bore 96. For a 12 gauge shellcase hull and .41 caliber projectile, the outside diameter is approximately 0.720 inch (manufacturer dependent as is the case with choke tube outside diameters) and thickness is approximately the difference between the outside diameter and the .41 caliber bore, or 0.155 inch. Rifled barrel insert 90 is typically formed of various alloys of steel, similar to standard barrel 92. A chamber end 98 of rifled barrel insert 90, which is adjacent to a chamber 100, retains sabot 30 in shotshell hull 24 upon firing, thereby separating projectile 26 from the sabot. A throat taper 65" of rifle barrel insert 90 near chamber end 98 guides projectile 26 into final sub-caliber, rifled bore 96. Thus, barrel insert 90 provides the sabot retention and sub-caliber bore features of specialized barrel 34 referenced in the above embodiments. In general, it is contemplated that rifled barrel insert 90 will be used to temporarily convert an existing shotgun barrel to allow proper firing of shotshell cartridges 22. A user may return standard barrel 92 to its original configuration by removing rifled barrel insert 90.

The shotshell cartridges and specialized small-bore shotgun barrel and chamber of the present invention offer advantages over other sabot-type cartridges and systems for firing sabot-type cartridges. Upon firing of the cartridge, the specialized barrel and chamber retains the sabot in the shellcase and chamber while the sub-caliber projectile is propelled down bore and out the muzzle. The resultant ejecta weight includes only the projectile and burning propellant, thus maximizing the projectile velocity and minimizing felt recoil energy for a given velocity level. With the projectile/sabot separation occurring in the chamber rather than at muzzle exit, the projectile is by default precisely centered in the sub-caliber bore and no separation forces are induced at muzzle exit, both of which contribute to improved accuracy. In addition, because the separation occurs in the chamber, considerably smaller-diameter, projectiles that are more efficient can be used without negative effects on accuracy. Also, by retaining the sabot in the chamber, the present invention offers an environmentally friendly alternative over known sabot cartridges and firing assemblies.

With bore size substantially smaller than the cartridge, various features have been incorporated in the design to prevent or counteract improper use. The cartridge length is significantly shorter than standard shotshell cartridges. The shorter chamber of the specialized barrel will prevent standard cartridges from chambering and firing into the restricted bore. In the event the short cartridge is mistakenly fired in a standard barrel, the expanding propellant gases push the entire sabot/projectile assembly out the barrel. To maintain the sabot and projectile as a unit for this situation, a rigid washer is insert-molded as a platform for the projectile. The washer counteracts projectile setback forces during ignition to keep the projectile in the sabot. This component serves no purpose when the cartridge is fired in the specialized barrel, but is merely a means to ensure the sabot/projectile unit completely exits the barrel when mistakenly fired in a standard barrel. Firing in a standard barrel is not the intended use for the product, and will not be effective at harvesting game.

The following example is presented to illustrate the invention at hand. Several 12 gauge shotshell cartridges having a length of 1.85 inches, containing 51 grains of WC 732 propellant, as manufactured by Primex Technologies, Inc., and a 175 grain .41 caliber projectile housed in a sabot were assembled. The cartridges were fired in a test barrel with a chamber having a length of 1.85 inches, i.e., similar to the chamber shown in FIG. 2. An average velocity of 1970 fps was recorded with a pressure level of 10,700 psi. In a second example, a 12 gauge cartridge having a length of 1.85 inches containing 48 grains of C1700 propellant, as manufactured by Western Powder Company, and a 240 grain .41 caliber projectile, yielded an average velocity of 1828 fps at a pressure level of 14,300 psi. Location of the pressure transducer was at the industry standard of 1.00 inch from bolt face. Because the sabot is retained in the shellcase during firing, a 0.250 inch hole was drilled through the sabot wall at the transducer location to properly transmit the chamber pressure to the transducer. Accuracy testing at 100 yards using cartridges of the second example yielded an average extreme spread of 1.65 inches for five shot targets.

Although the invention has been described and illustrated with respect to exemplary embodiments thereof, it should be understood by those skilled in the art that the foregoing and various other changes, omissions and additions may be made therein and thereto, without parting from the spirit and scope of the present invention. For example, manufacturing techniques, equipment, and materials may vary and varying artifacts of manufacture may arise. Accordingly, other embodiments are within the scope of the following claims.

What is claimed is:

1. A shotgun barrel for adapting a standard shotgun to fire sabot-retaining shotshell cartridges including sub-caliber projectile comprising:

a chamber including a diameter and length adapted to accept the cartridge;

a rifled bore having a diameter substantially the same as a diameter of the sub caliber projectile; and a transitional area between said chamber and said bore for retaining a sabot of the cartridge in a hull of the cartridge upon firing, wherein said transitional area includes an annular tang extending axially from the end of the said rifled bore into said chamber the tang being sufficiently long to extend between the projectile and the sabot of a shell disposed in the chamber.

2. A shotgun barrel according to claim 1, wherein a portion of said annular tang having a length of 0.10 to 0.75 extends into said chamber.

3. A shotgun barrel according to claim 1, wherein said annular tang has a radial thickness of 05. to 0.20 inch.

4. A shotgun barrel according to claim 1, wherein said chamber is 10 gauge, 12 gauge, 16 gauge, 20 gauge, 28 gauge, or 410 gauge.

5. A shotgun barrel according to claim 1, wherein said rifled bore has a diameter of less than .54 caliber.

6. A shotgun barrel according to claim 1, wherein said chamber has a length of less than 2.2 inches long.

7. A shotgun barrel according to claim 1, wherein the interior of the tang includes a taper throat, which leads to the rifled bore.

8. In combination with a shotshell cartridge having a hull including a sub-caliber projectile in a sabot, a shotgun barrel for firing the shotshell cartridge, the barrel comprising a chamber including a diameter and length adapted to accept the cartridge, with the shotshell cartridge being disposed therein;

a rifled bore having a diameter substantially the same as a diameter of the sub-caliber projectile of the shotshell cartridge; and a transitional area between said chamber and said bore for retaining the sabot of the cartridge in the hull of the cartridge upon firing, the transitional area including an annular tang extending axially from the end of the said rifled bore into the chamber, with a portion of the tang extending between the projectile and the sabot of the shotshell cartridge.

9. The combination according to claim 8, wherein an annular groove having a depth of 0.12 to 0.77 inch and a width of 0.06 to 0.22 inch wide is formed between a frontal portion of the sub-caliber projectile and an annular step of the sabot.

10. The combination according to claim 8 wherein the sabot has a shoulder formed therein, and wherein the distal end of the tang engages the shoulder of the sabot.

11. The combination according to claim 10, wherein the interior of the tang includes a taper throat, which leads to the rifled bore.

12. The combination according to claim 8, wherein the interior of the tang includes a taper throat, which leads to the rifled bore.

* * * * *